US006749129B2

(12) United States Patent
Hefler et al.

(10) Patent No.: US 6,749,129 B2
(45) Date of Patent: Jun. 15, 2004

(54) DIRECTLY CONTROLLED FUEL INJECTOR WITH SEALING AGAINST FLUID MIXING

(75) Inventors: Gregory W. Hefler, Chillicothe, IL (US); Sudhindra K. Ayanji, Peoria, IL (US); Ye Tian, Bloomington, IL (US); Scott F. Shafer, Morton, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/209,530

(22) Filed: Jul. 31, 2002

(65) Prior Publication Data

US 2004/0021003 A1 Feb. 5, 2004

(51) Int. Cl.[7] ..... F02M 47/02
(52) U.S. Cl. ..... 239/88; 239/96; 239/124
(58) Field of Search ..... 239/96, 88, 124, 239/127, 585.1, DIG. 4

(56) References Cited

U.S. PATENT DOCUMENTS 5,687,693 A * 11/1997 Chen et al. ..... 123/446
5,738,075 A * 4/1998 Chen et al. ..... 123/446
5,901,686 A 5/1999 Stockner et al.
5,992,768 A 11/1999 Beatty et al.
6,050,497 A * 4/2000 Cotton ..... 239/96
6,168,091 B1 * 1/2001 Rodier et al. ..... 239/88
6,454,189 B1 * 9/2002 Krishnamurthy ..... 239/533.2
6,543,784 B2 * 4/2003 Gasper et al. ..... 277/438

* cited by examiner

*Primary Examiner*—Henry Bennett
*Assistant Examiner*—Amanda Flynn
(74) *Attorney, Agent, or Firm*—Liell & McNeil

(57) ABSTRACT

A fuel injector with a direct control needle valve has a closing hydraulic surface exposed to a control fluid, and an opening hydraulic surface exposed to fuel. The control fluid is different from the fuel. A vented annulus is positioned around the needle valve member between the control fluid chamber and the fuel chamber. An o-ring is positioned in a lower pressure region between the annulus and the control fluid chamber.

19 Claims, 3 Drawing Sheets

DIRECTLY CONTROLLED FUEL INJECTOR WITH SEALING AGAINST FLUID MIXING

TECHNICAL FIELD

This invention relates generally to fuel injector systems utilizing a direct control needle valve, and more particularly a fluid sealing strategy to prevent mixing between fuel fluid and control fluid.

BACKGROUND

A common type of fuel injector system utilizes a direct control needle valve to open and close the nozzle outlets of the fuel injector. One end of the needle valve member is exposed to medium or low pressure control fluid in a needle control chamber, while a different portion is exposed to high or low fuel pressure in a nozzle chamber in a cyclic manner for each injection cycle. The nature of a needle valve is that extreme pressure differences are present between the needle control chamber and the nozzle chamber, where the needle valve member is positioned. These extreme pressure differences facilitate the lifting and closing of the needle valve and the resulting injection event. While the fuel acts as the pressurized fluid in the nozzle chamber, one class of fuel injectors use engine lubricating oil, or a similar fluid that is different from fuel, as the pressurized fluid in the needle control chamber.

A reoccurring issue with such an arrangement is the possibility of mixture between the oil in the needle control chamber and the fuel in the nozzle chamber. Because of the slight diametrical clearance between the needle valve member and its guide bore(s), migration of the fluids can occur in either direction as a result of the repetitive motion of the needle valve and the extreme difference in pressures between the oil and the fuel during different portions of the injection event. Depending on the timing in the injection cycle, the high-pressure location could be in the nozzle chamber or the needle control chamber. The migration of oil into the nozzle chamber can cause undesirable emissions when the fuel/oil mixture is injected into the combustion space. On the other hand, fuel migration into the needle control chamber can undermine the lubricating properties of the oil throughout the engine. Therefore, maintaining separation of the fluids is important to engine operation, performance and emissions.

Prior art has taught the use of an o-ring as an effective sealant against oil or fuel leakage. While an o-ring alone can provide a sufficient seal between the two fluids, research has shown that improperly applied o-rings typically fail long before the other parts of the fuel injector. The fuel injector's extreme pressure, temperature requirements and high frequency of movements can prove to be fatal to the o-ring structure to the point that the o-ring becomes functionally useless. Furthermore, a degraded o-ring can provide a collection point for the oil or the fuel during the migration process, resulting in the potential to hasten the mixture problem.

One example of a fuel injector sealing strategy using an o-ring is taught by Stockner et al. in U.S. Pat. No. 5,901,686, entitled Fluid Seal For Cyclic High Pressures Within a Fuel Injector. While Stockner et al. teaches an effective sealing strategy in the plunger region, their strategy leaves room for improvement in the nozzle assembly portion of a directly controlled fuel injector.

The present invention is directed at overcoming one or more of the problems set forth above.

SUMMARY OF THE INVENTION

A fuel injection system includes of a source of control fluid, a source of fuel fluid and a fuel injector. The fuel injector is connected to the source of fuel fluid and control fluid, and has a direct control needle valve. The direct control needle valve has a needle valve member having a closing hydraulic surface exposed to the fluid pressure in a control chamber, and an opening hydraulic surface exposed to a fluid pressure in a fuel chamber. The direct control needle valve includes at least one guide region, at least one o-ring and at least one annulus positioned between the control fluid chamber and fuel chamber. A vent passage is disposed within the fuel injector and is connected to one of the at least one annulus.

In another aspect, a fuel injector includes an injector body that defines a control chamber, a fuel chamber, a control fluid vent passage and a fuel vent passage. Also, the fuel injector includes a direct control needle valve with a needle valve member having a closing hydraulic surface exposed to the fluid pressure in the control chamber, and an opening hydraulic surface exposed to a fluid pressure in the fuel chamber. At least one of the injector body and needle valve member define a first annulus fluidly connected to the control fluid vent passage, and a second annulus fluidly connected to the fuel vent passage.

In another aspect, a method of separating fluids in a fuel injector with a direct control needle valve includes a step of fluidly connecting a first annulus surrounding a needle valve member to a control fluid vent passage. A first guide region is positioned between a control chamber and the first annulus. A second annulus surrounding the needle valve member is fluidly connected to a fuel vent passage. A second guide region is positioned between a fuel chamber and the second annulus.

DETAILED DESCRIPTION

Figure 1:
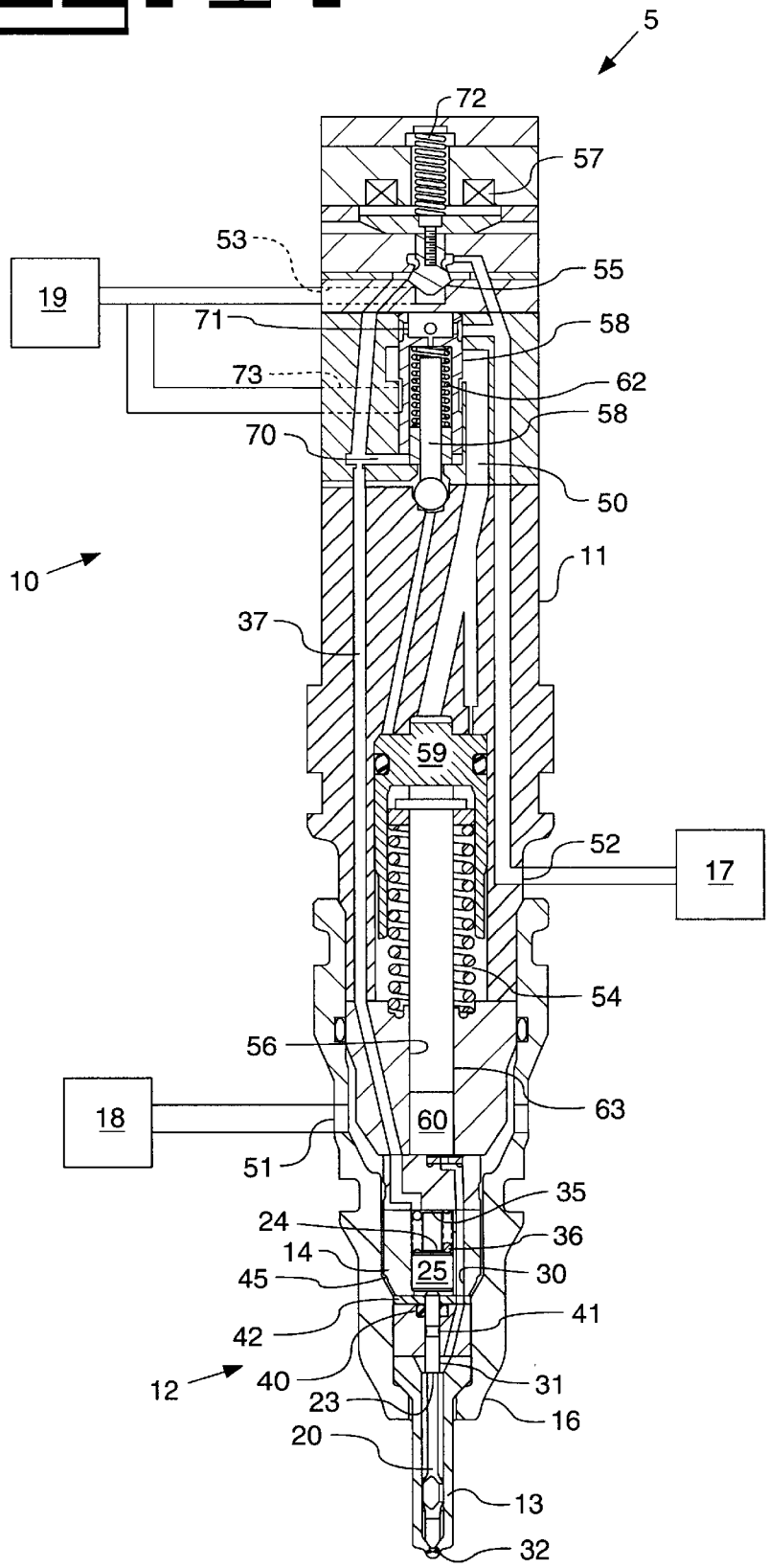
FIG. 1 is a schematic representation of the fuel injection system, including a sectioned front view of a fuel injector according to the present invention.

Referring to FIG. 1, a schematic representation of fuel injection system 5 is shown, including a sectioned front view of a fuel injector 10 according to the preferred embodiment of the present invention. Fuel injection system 5 includes a source of actuation fluid 17, a source of fuel fluid 18 and low pressure drain 19 all connected to fuel injector 10. Fuel injector 10 is shown to be hydraulically-actuated using a single two-position solenoid 57 to ultimately facilitate the distribution of fuel from fuel inlet 51 to nozzle outlet 32. Those skilled in the art will recognize that the present invention is equally applicable to injectors having different types of electrical actuators (e.g. piezoelectric actuators) and differing numbers (two or more) of the same. The opening and closing of nozzle outlet 32 is controlled by direct control needle valve 12 that includes needle valve member 20. Fuel injector 10 also includes fuel injector body 11 containing several moveable components in their respective positions they would occupy prior to a fuel injection cycle occurring. Prior to a fuel injection event, solenoid 57 is in its de-energized state, allowing pressure control passage 37 to be in fluid communication with high pressure actuation fluid inlet 52. In addition, spool valve member 58 includes a biasing hydraulic surface exposed to high pressure actuation fluid via hollow interior 71 and a control hydraulic surface exposed to high pressure via branch control passage 70. These two hydraulic surface areas of spool valve member 58 are preferably equal such that the net force on spool valve member 58 is from the biasing force of spool valve biasing spring 62, which biases spool valve member 58 toward its upward position. Injector 10 also includes a control valve member 55, which moves between a downward position in contact with a low pressure seat (as shown), and an upward position in contact with a high pressure seat. Control valve member 55 is biased downward by the biasing force of control valve biasing spring 72. Injector 10 also includes plunger bore 56, within which plunger 63 reciprocates between a retracted position (as shown) and an advanced position. Plunger 63 is biased toward its retracted position by the biasing force of piston return spring 54. A portion of plunger bore 56, and plunger 63 define a fuel pressurization chamber 60.

Actuation fluid, preferably in the form of engine lubricating oil, or any other type of fluid typically known in the art such as coolant or transmission fluid, can be used as the actuation fluid entering fuel injector body 11 through actuation fluid inlet 52 from the source of actuation fluid 17. As a result of fluid communication with pressure control passage 37, needle control chamber 35 is fluidly connected to high pressure and the high pressure actuation fluid acts on the closing hydraulic surface 24 of needle valve member 20. This fluidic pressure force, along with the biasing force of biasing spring 36, act in maintaining needle valve member 20 in its downward closed position, resulting in nozzle outlet 32 being blocked from fuel communication with fuel pressurization chamber 60 via nozzle supply passage 30.

When an injection event is to occur, low pressure fuel is introduced into fuel pressurization chamber 60 from the source of fuel fluid 18 via fuel inlet 51 and a hidden low pressure passage. Solenoid 57 is energized and the resulting magnetic flux pulls control valve member 55 toward its upward position against the biasing force of control valve biasing spring 72 and control valve member 55 is raised to close its high pressure seat. The resulting movement of control valve member 55 blocks high pressure fluid communication between pressure control passage 37 and actuation fluid inlet 52, and opens fluid communication between pressure control passage 37 and low pressure passage 53. In other words, when solenoid 57 is energized, pressure control passage 37, as well as branch control passage 70, are in fluid communication with low pressure passage 53. As a result, spool valve member 58 has a high pressure fluid force acting from above via hollow cavity 71 and a low pressure fluid force acting below via branch control passage 70. The low pressure force acting within branch control passage 70 and the biasing force of spool valve biasing spring 62 are weaker then the fluid pressure force of the actuation fluid in hollow cavity 71. Therefore, the spool valve member 58 moves downward where upon actuation fluid inlet 52 becomes in fluid communication with actuation fluid cavity 50. The resulting fluid pressure in actuation fluid cavity 50 acts on the top of intensifier piston 59 to drive plunger 63 downward against the weaker biasing force of piston return spring 54, pressurizing the fuel inside fuel pressurization chamber 60.

Pressurized fuel in fuel pressurization chamber 60 is distributed to direct control needle valve 12 via nozzle supply passage 30. The fuel enters nozzle chamber 31 where the high pressure fuel acts on opening hydraulic surface 23 of needle valve member 20. When the pressure in nozzle chamber 31 reaches a specific needle valve opening pressure, the fuel acts on opening hydraulic surface 23 to counter the low pressure fluid force acting on the closing hydraulic surface 24 and the biasing force of biasing spring 36. As a result, needle valve member 20 moves from its closed position toward its open position, unblocking nozzle outlet 32. Consequently, fuel communication is maintained between nozzle outlet 32 and fuel pressurization chamber 60, and the high pressure fuel can be sprayed into the engine cylinder.

The end of an injection event is initiated with the de-energizing of solenoid 57 and resulting discontinuation of the magnetic flux allows control valve biasing spring 72 to force downward control valve member 55 to close its low pressure seat. Consequently, pressure control passage 37 becomes fluidly reconnected to actuation fluid inlet 52. Once again, needle control chamber 35 is exposed to high pressure actuation fluid acting on closing hydraulic surface 24. The combination of high actuation fluid pressure in nozzle chamber 35 and biasing force of biasing spring 36 is sufficient to quickly drive the needle valve member 20 back toward its closed position, once again blocking nozzle outlet 32. Along with pressure control passage 37 being exposed to high pressure, spool valve member 58 is once again exposed to balancing fluidic pressures and the spool valve biasing spring 62 moves spool valve member 58 toward its upward biased position. When spool valve member 58 is in its upward position, actuation fluid cavity is in fluid communication with actuation fluid drain 73, which drains to low pressure reservoir 19. The drop in fluid pressure on intensifier piston 59 allows piston return spring 54 to return plunger 56 toward its upward position. As plunger 56 moves upward, a new charge of low pressure fuel from fuel inlet 51 is moved into fuel pressurization chamber 60.

Figure 2:
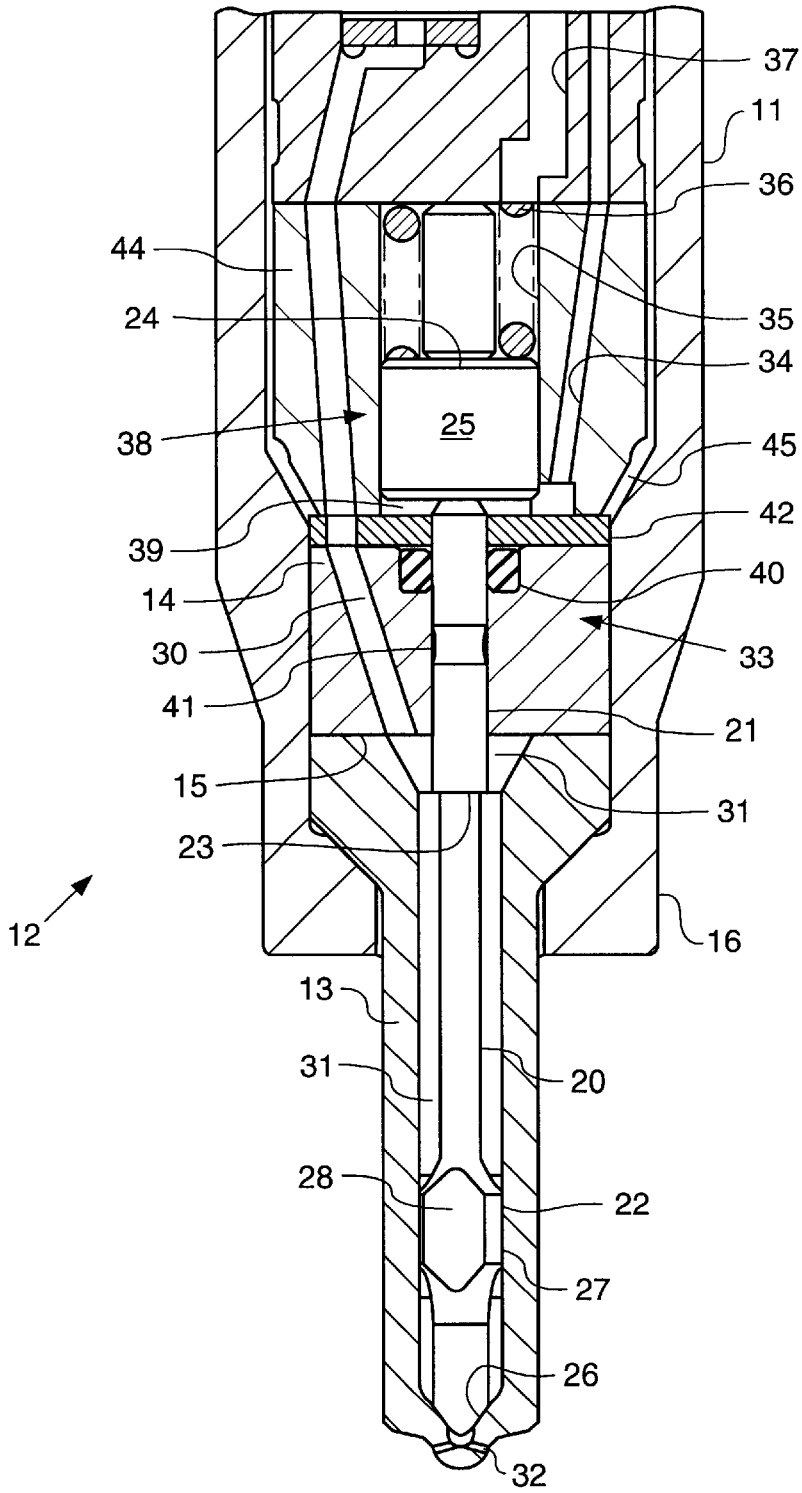
FIG. 2 is an enlarged sectioned front view of the direct control needle valve portion of the fuel injector of FIG. 1.
Figure 3:
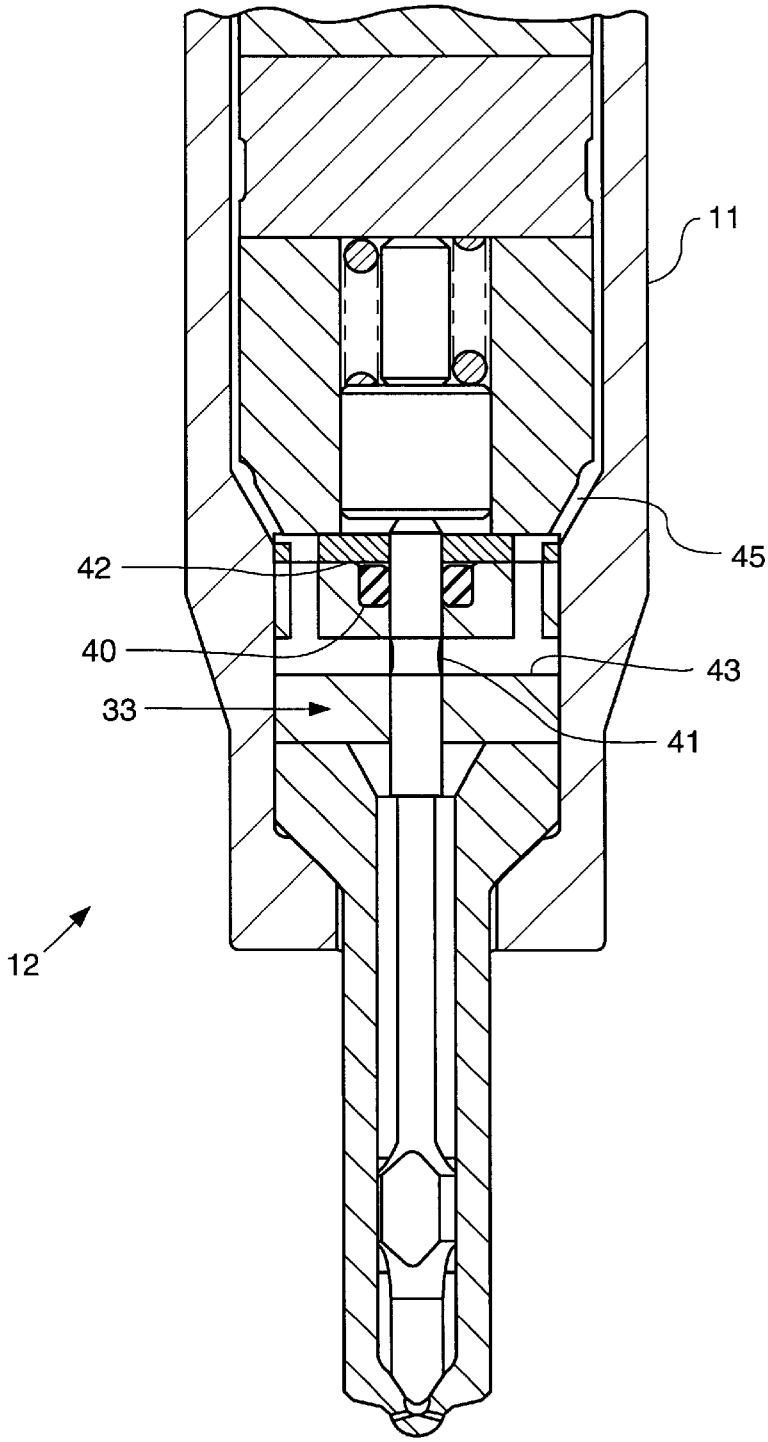
FIG. 3 is an enlarged sectioned side view of the direct control needle valve portion of the fuel injector of FIG. 1.

Referring now to FIGS. 2–3, an enlarged sectioned view of the nozzle portion of fuel injector 10 showing the fluid passages associated with direct control needle valve 12. Injector body 11 in the vicinity of direct control needle valve 12 includes, in particular, a lower tip component 13, an upper tip component 14, a backup plate 42, a sleeve 44 and a casing 16. Machined within lower tip component 13 is a frustoconical valve seat 26. Upper tip component 14, has a guide region 33 running through it and is positioned above lower tip component 13 such that preferably the bottom surface 15 of upper tip component 14 defines the upper boundary of nozzle chamber 31. The diameter of nozzle chamber 31 is such that needle valve member 20 has a small diametrical clearance to guide movement between its open and closed positions. It can be appreciated that the centerline for needle valve member 20, lower tip component 13 and upper tip component 14 are all in alignment in order reduce the possibility of a stuck or misaligned needle in fuel injector 10.

Needle valve member 20 includes an upper guide portion 21, a lower guide portion 22 and an intensifier portion 25. Also, needle valve member 20 defines a fuel vent annulus 41. FIGS. 2–3 show fuel vent annulus 41 being defined solely by needle valve member 20, but it can be appreciated that fuel vent annulus 41 could be defined solely by upper tip component 14 or be defined by both needle valve member 20 and upper tip component 14. Preferably fuel vent annulus 41 is positioned between o-ring 40 and nozzle chamber 31. Also shown on needle valve member 20 is its lower guide portion 22 containing a plurality of partial cylindrical portions 27 which alternate with a plurality of equally spaced flat surfaces 28 about needle valve member 20. One skilled in the art could appreciate that various geometrical configurations could be used in place of the alternating partial cylindrical portions 27 and flat surfaces 28.

Upper tip component 14 includes a counterbore where o-ring 40 is contained. O-ring 40 acts as a sealant between the actuating fluid in needle control chamber 35 and fuel in nozzle chamber 31. It can be appreciated that o-ring 40 preferably has D-shaped cross section and that o-ring 40 could be manufactured with any suitable material known in the art. Besides the sealing properties of o-ring 40, backup plate 42 is placed above o-ring 40 to keep it located in the counterbore. Backup plate 42 is positioned above upper tip component 14 and is preferably machined to have a substantially larger diameter than the guide region 33 of upper tip component 14 to avoid misalignment issues. It should be noted that o-ring 40, fuel vent annulus 41 and guide region 33 are preferably located at least partially within upper tip component 14. Also located with upper tip component 14 is fuel vent passage 43 (as shown in FIG. 3) which is a series of passages that are drilled in upper tip component 14 to connect fuel vent annulus 41 to low pressure area 45. Preferably, fuel vent passage 43 is in fluid communication with the fuel injector 10 source of low pressure fuel, fuel inlet 51. Fuel vent passage 43 has been shown in FIG. 3 as containing two passages but it should be noted that such an arrangement could be replaced with one or a plurality of different passages.

Along with needle valve member 20 and backup plate 42, sleeve 44 defines oil vent annulus 39. Connected to oil vent annulus 39 is oil vent passage 34, which is preferably in fluid communication with a low pressure oil area, such as actuation fluid drain 73. Depending upon pressures and other concerns known in the art, the positions of o-ring 40, oil vent annulus 39 and fuel vent annulus 41 could be altered and/or vents 34 or 43 could be connected to differing low pressure areas.

Industrial Applicability

Returning now to FIG. 1, the fuel injector 10 components are shown prior to an injection event. The biasing force of biasing spring 36 exerts a mechanical force and a high pressure hydraulic force so that needle valve member 20 is in its downward closed position blocking nozzle outlet 32. Also, the biasing force of control valve biasing spring 72 exerts a mechanical force such that control valve member 55 is in contact with the low pressure seat. Furthermore, the biasing force of piston return spring 54 maintains intensifier piston 59 and plunger 63 in their respective retracted positions. Also, spool valve member 58 is biased toward its upward position because of the biasing spring force of spool valve biasing spring 62 and the cancellation of pressure forces between hollow cavity 71 and branch control passage 70. Finally, high pressure actuation fluid from actuation fluid inlet 52 is dispersed throughout the control pressure line 37, the branch control passage 70 and needle control chamber 35. It should be noted that the fluid pressure in needle control chamber 35 acts on closing hydraulic surface 24 to aid in holding needle valve member 20 in its downward closed position.

To start an example injection process to produce one of several available rate shapes, solenoid 57 is energized and the resulting magnetic flux pulls control valve member 55 upward, overcoming the biasing force of control valve biasing spring 72 and control valve member 55 moves toward its upward position closing the high pressure seat. The raising of control valve member 55 breaks communication between actuation fluid inlet 52 and pressure control passage 37, and opens communication between low pressure passage 53 and pressure control passage 37. About this time, spool valve member 58 experiences a difference in pressure resulting from the high pressure fluid force acting above via hollow interior 71 and low pressure fluid force acting below via branch control passage 70. This fluid pressure force differential is sufficient to counter the biasing force of spool valve biasing spring 62 and spool valve member 58 moves downward such that actuation fluid cavity 50 is in fluid communication with actuation fluid inlet 52. The resulting high pressure force in actuation fluid cavity 50 acts on intensifier piston 59 to counter the biasing force of piston return spring 54, and the fuel in fuel pressurization chamber 60 is pressurized. Next, the pressurized fuel is transferred to nozzle chamber 31 via nozzle supply passage 30. The fuel pressure acts on the opening hydraulic surface 23 of needle valve member 20 to counter the biasing force of biasing spring 36 and the low pressure being exerted on closing hydraulic surface 24. The movement of needle valve member 20 to its open position allows fluid communication between nozzle outlet 32 and fuel pressurization chamber 60 such that fuel is injected into the engine cylinder.

The end of an injection event is triggered with the de-energizing of solenoid 57, and control valve member 55 returning to its downward, low pressure seat. Pressure control passage 37 becomes fluidly reconnected to actuation fluid inlet 52 resulting in needle control chamber 35 being re-exposed to high pressure actuation fluid. The fluid force acting on closing hydraulic surface 24 forces needle valve member 20 back to its biased downward closed position, blocking nozzle outlet 32. Spool valve biasing spring 62 moves spool valve member 58 toward its upward biased position once the hydraulic pressures acting on spool valve member 58 become approximately equal. Actuation fluid cavity 50 comes into fluid communication with actuation fluid drain 73, and the drop in fluid pressure on intensifier piston 59 allows plunger 56 to return to its upward position. As plunger 56 moves upward, a new charge of low pressure fuel is moved into fuel pressurization chamber 60 via fuel inlet 51 and the entire fuel injection process can be repeated.

Referring now back to FIGS. 2–3, during a fuel injection event, a fluid pressure gradient is created between the fuel in the nozzle chamber 31 and the actuation fluid in the needle control chamber 35. Prior to the injection event, needle control chamber 35 is exposed to the high pressure actuation fluid from pressure control passage 37. This fluid pressure is acting on closing hydraulic surface 24 of intensifier portion 25 of needle control member 20. During the same time, the opening hydraulic surface 23 of needle control member 20 is experiencing the fluidic forces of the low pressure fuel. Because of the slight diametrical clearances, the actuation fluid will tend to migrate downward past intensifier portion 25 and mix with the fuel. Similarly, the opposite path of migration, fuel migrating upward past intensifier guide region 38 and mixing with the actuation fluid can occur during an injection event when needle control chamber 35 is experiencing low pressure. Thus o-ring 40 is positioned in a lower pressure area between oil vent passage 34 and low pressure fuel area 45, reducing the mixing of the actuation fluid and the fuel. The o-ring 40 preferably is in a constant contact with upper guide portion 21 without sacrificing any vertical mobility of needle control member 20. The o-ring 40 allows the needle control member 20 to glide upwards and downwards, but seals the actuation fluid and fuel from migrating past the o-ring 40 into the other fluid.

While the o-ring 40 seals against mixing, one of the distinguishing advantages of the present invention is the inclusion of fuel vent passage 43 and an oil vent passage 34. Fuel vent annulus 41 included on needle control member 20 behaves as a collection point for the fuel migrating toward o-ring 40 from nozzle chamber 31. It should be noted that fuel vent annulus 41 could be located within upper tip component 14 or be defined as a combination of an annulus on needle control member 20 and an annulus within upper tip component 14. Fuel vent passage 43 is utilized to connect fuel vent annulus 41 with low pressure space 45. The migrating fuel from nozzle chamber 31 comes to fuel vent annulus 41 and escapes to low pressure space 45 for recirculation instead of continuing to migrate upward toward oil vent passage 34. In a similar manner, the possible inclusion of oil vent passage 34 is advantageous, in that it allows actuation fluid to collect in oil vent annulus 39 and escape to a low pressure oil area, such as actuation fluid drain 73, via oil vent passage 34. Therefore, the advantage of oil vent passage 34 and fuel vent passage 43 is the minimization of contact between o-ring 40 and the high pressures of the actuation fluid and pressurized fuel, respectively, that exist at different times away from the vent annuluses. This reduction in the fluid pressures seen by the o-ring 40 increases the life expectancy of o-ring 40 so that it can operate during the full life expectancy of the entire fuel injector 10.

The length and clearance of the guide region have a strong influence on the leakage rate between the oil vent passage 34 and fuel vent passage 43. It can be appreciated that one skilled in the art could eliminate the o-ring 40 while keeping these two vent passages, if the guide region, upper guide portion 22 and intensifier guide region 38, was increased to a sufficient length with an appropriate diametrical clearance. The fluidic properties of the fluids and the increase in guide length could be designed such that mixing of the two fluids would be reduced to acceptable levels. The relatively small amount of fluid circulation provided by the vented oil and fuel annuluses flushes the injector and avoids some problems associated with debris accumulations.

The above description is for illustrative purposes only, and is not intended to limit the scope of the invention in any way. For instance, the illustrated embodiment shows upper tip component 14 and lower tip component as separate pieces. Those skilled in the art will recognize that these two components could be merged into a single piece. Such an alternative might be attractive for several known reasons, e.g. manufacturability etc., but might also permit the guide 27 to be omitted. Those skilled in the art will appreciate that a wide variety of modifications could be made to the illustrated o-ring, guide regions and vent passages without departing from the intended scope of the invention, which is defined by the claims set forth below.

What is claimed is:

1. A fuel injection system comprising:

a source of actuation fluid;

a source of fuel fluid;

a fuel injector connected to said source of actuation fluid and said source of fuel, and including a direct control needle valve with a needle valve member having a closing hydraulic surface exposed to fluid pressure in a control fluid chamber, and an opening hydraulic surface exposed to fluid pressure in a fuel chamber;

said direct control needle valve including at least one guide region, at least one o-ring and at least one annulus positioned between said control fluid chamber and said fuel chamber; and a vent passage disposed within said fuel injector and fluidly connected to one of said at least one annulus.

2. The fuel injection system of claim 1 wherein said o-ring is positioned between a first annulus and a second annulus.

3. The fuel injection system of claim 1 wherein said o-ring is positioned between a first guide region and a second guide region.

4. The fuel injection system of claim 1 wherein said at least one annulus includes a first annulus fluidly connected to a low pressure control fluid vent passage, and a second annulus fluidly connected to a low pressure fuel vent passage.

5. The fuel injection system of claim 1 wherein one of said at least one o-ring, one of said at least one annulus and one of said at least one guide region are located at least partially within a single injector body component.

6. The fuel injection system of claim 1 wherein said at least one annulus includes a first annulus fluidly connected to a low pressure control fluid vent passage, and a second annulus fluidly connected to a low pressure fuel vent passage;

said at least one guide region includes a first guide region located between said control fluid chamber and said first annulus, and a second guide region located between said second annulus and said fuel chamber.

7. The fuel injection system of claim 1 wherein said injector body includes a lower tip component and an upper tip component; and said fuel chamber is at least partially defined by said lower tip component and a bottom surface of said upper tip component.

8. A fuel injector comprising:

an injector body defining a control chamber, a fuel chamber, a control fluid vent passage and a fuel vent passage;

a direct control needle valve including a needle valve member with a closing hydraulic surface exposed to fluid pressure in said control chamber, and an opening hydraulic surface exposed to fluid pressure in said fuel chamber;

at least one of said injector body and said needle valve member defining a first annulus fluidly connected to said control fluid vent passage, and a second annulus fluidly connected to said fuel vent passage.

9. The fuel injector of claim 8 wherein said direct control needle valve includes a first guide region located between said control chamber and said first annulus, and a second guide region located between said fuel chamber and said second annulus.

10. The fuel injector of claim 9 including an o-ring in contact with said injector body and said needle valve member between said first annulus and said second annulus.

11. The fuel injector of claim 10 wherein said o-ring is positioned between a first guide region and a second guide region that are located between said control chamber and said fuel chamber.

12. The fuel injector of claim 11 wherein said o-ring, said second annulus and said second guide region are located at least partially within a single injector body component.

13. The fuel injector of claim 12 wherein said injector body includes a lower tip component and an upper tip component; and said fuel chamber is at least partially defined by said lower tip component and a bottom surface of said upper tip component.

14. The fuel injector of claim 8 including an o-ring positioned between said first annulus and said second annulus.

15. The fuel injector of claim 14 wherein said injector body includes a lower tip component and an upper tip component; and said fuel chamber is at least partially defined by said lower tip component and a bottom surface of said upper tip component.

16. A method of separating fluids in a fuel injector with a direct control needle valve comprising the steps of:

fluidly connecting a first annulus surrounding a needle valve member to a control fluid vent passage;

positioning a first guide region between a control chamber and said first annulus;

fluidly connecting a second annulus surrounding said needle valve member to a fuel vent passage; and positioning a second guide region between a fuel chamber and said second annulus.

17. The method of separating fluids of claim 16 including a step of positioning an o-ring between said first annulus and said second annulus.

18. The method of separating fluids of claim 17 including a step of locating said second annulus, said second guide region and said o-ring at least partially within a single injector body component.

19. The method of separating fluids of claim 18 including a step of partially defining said fuel chamber with a bottom surface of said single injector body component;

exposing an opening hydraulic surface on said needle valve member to fluid pressure in said fuel chamber; and exposing a closing hydraulic surface on the needle valve member to fluid pressure in said control chamber.

* * * * *